United States Patent [19]

Harrison et al.

[11] Patent Number: 4,775,657

[45] Date of Patent: Oct. 4, 1988

[54] OVERCOAT FOR DYE IMAGE-RECEIVING LAYER USED IN THERMAL DYE TRANSFER

[75] Inventors: Daniel J. Harrison; Paul D. Yacobucci, both of Rochester; Kin K. Lum; David B. Bailey, both of Webster, all of N.Y.

[73] Assignee: Eastman Kodak Company, Rochester, N.Y.

[21] Appl. No.: 154,764

[22] Filed: Feb. 11, 1988

Related U.S. Application Data

[63] Continuation-in-part of Ser. No. 62,795, Jun. 16, 1987, abandoned.

[51] Int. Cl.[4] ..... B41M 5/035; B41M 5/26

[52] U.S. Cl. ..... 503/227; 8/471; 427/146; 427/256; 428/195; 428/212; 428/412; 428/423.1; 428/913; 428/914

[58] Field of Search ..... 8/470, 471; 346/135.1; 427/146, 256; 428/195, 212, 412, 423.1, 474.4, 480, 913, 914; 503/227

[56] References Cited

U.S. PATENT DOCUMENTS

| | | | |
|---|---|---|---|
| 4,626,256 | 12/1986 | Kawasaki et al. | 428/195 |
| 4,695,286 | 9/1987 | Vanier et al. | 503/227 |

FOREIGN PATENT DOCUMENTS

| | | | |
|---|---|---|---|
| 0138483 | 4/1985 | European Pat. Off. | 503/227 |
| 19138 | 1/1985 | Japan | 503/227 |
| 60/192630 | 10/1985 | Japan | 503/227 |

*Primary Examiner*—Bruce H. Hess
*Attorney, Agent, or Firm*—Harold E. Cole

[57] ABSTRACT

A dye-receiving element for thermal dye transfer comprises a support having thereon a dye image-receiving layer, such as a polycarbonate, coated with an overcoat layer comprising a condensation polymer comprising recurring units of a linear chain having at least four carbon atoms, such as a polyester or a polyurethane, the overcoat layer having a $T_g$ of at least 40° C. less than the $T_g$ of the dye image-receiving layer.

Use of the overcoat layer of the invention helps to destratify the dye and improves stability of the transferred dyes to light.

19 Claims, No Drawings

OVERCOAT FOR DYE IMAGE-RECEIVING LAYER USED IN THERMAL DYE TRANSFER

This application is a continuation-in-part of application Ser. No. 062,795, filed June 16, 1987, now abandoned.

This invention relates to dye-receiving elements used in thermal dye transfer, and more particularly to the use of an overcoat layer on a dye image-receiving layer to improve stability of the transferred dyes to light.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

In Japanese laid open publication No. 19,138/85, an image-receiving element for thermal dye transfer printing is disclosed. The dye image-receiving layer disclosed comprises a polycarbonate containing a plasticizer.

U.S. Pat. No. 4,695,286 of Vanier and Lum, issued Sept. 22, 1987, relates to dye-receiving elements for thermal dye transfer having a high molecular weight polycarbonate dye image-receiving layer.

While polycarbonate is a desirable material for a dye image-receiving layer because of its effective dye compatibility and receptivity, a problem has developed with the dyes transferred to a polycarbonate receiving layer in that the dyes tend to fade upon exposure to light. One of the reasons for this is that the dyes appear to be concentrated near the surface and are thus more susceptible to degradation. While thermal fusing of the transferred dyes helps to improve the light stability problem, that technique cannot be used at a very high temperature when the receiver support is paper, since the fusing temperature tends to form blisters of trapped water vapor.

It would be desirable to provide a dye-receiving element which would destratify the dyes so that they would have improved light stability. It would also be desirable to eliminate the need for thermal fusing or at least reduce the temperature at which thermal fusing takes place.

These and other objects are achieved in accordance with this invention which comprises a dye-receiving element for thermal dye transfer comprising a support having thereon a dye image-receiving layer which is coated with an overcoat layer comprising a condensation polymer comprising recurring units of a linear chain having at least four carbon atoms, the overcoat layer having a $T_g$ of at least 40° C. less than the $T_g$ of the dye image-receiving layer.

It is believed that by overcoating the dye image-receiving layer in accordance with this invention with a thin, more permeable polymer than the dye image-receiving layer polymer, the transferred dyes are able to diffuse further away from the surface of the receiver. In addition, the distance between dye molecules is increased.

Not all of the transferred dye diffuses into the dye image-receiving layer. Some of the dye may remain in the overcoat layer.

In a preferred embodiment of the invention, the condensation polymer is a polyester such as polycaprolactone, a polycarbonate or poly(butylene adipate). In another preferred embodiment of the invention, the condensation polymer is a polyurethane.

If the $T_g$ of the overcoat layer is not at least 40° or less than the $T_g$ of the dye image-receiving layer, or the linear chain of the condensation polymer does not have at least four carbon atoms, then the improvement in dye stability is not obtained, as will be shown by comparative tests hereinafter. In addition, if the overcoat layer blends substantially into the dye image-receiving layer so that it loses its discrete identity as an overcoat layer, then the advantages of the invention may not be obtained.

The overcoat layer may be present in any amount which is effective for the intended purposes. In general, good results have been obtained at a concentration of from about 0.01 to about 2.0 g/m$^2$, preferbly from about 0.1 to about 0.5 g/m$^2$.

The dye image-receiving layer of the dye-receiver of the invention may comprise, for example poly(tetramethylbisphenol-A-azeloate), poly(octamethylene-(5-carboxy-1,3,3-trimethylindane-1-(phenyl-4-carboxylate))), poly(hexamethylene-(5-carboxy-1,3,3-trimethylindane-1-(phenyl-4-carboxylate))), poly(pentamethylene-(5-carboxy-1,3,3-trimethylindane-1-(phenyl-4-carboxylate))), poly(vinyl alcohol-co-benzal), poly(phenoxyethyl acrylate-co-acrylonitrile), poly(phenoxyethyl acrylate-co-methyl methacrylate, poly(styrene-co-epoxymethyl acrylate), poly(styrene-co-acrylonitrile-co-(1-methoxy-1-carboxymethyl)N-methyl acrylamide, poly(1,3-bis(p-hydroxycumyl)benzene-2,5-dimethylterephthalate), poly(bisphenol A-2,5-dimethylterephthalate), poly(bisphenol A-(5-carboxy-1,3,3-trimethylindane-1-(phenyl-4-carboxylate))), poly(ethylene-(5-carboxy-1,3,3-trimethylindane-1-(phenyl-4-carboxylate))), poly(ethylene-co-ethanol-2,2'-((hexahydro-4,7-methanolindon-5-ylidyne)-bis(p-phenyleneoxy))terephthalate), poly((polystyrene)acrylate-co-acrylonitrile), poly(styrene-co-acrylonitrile-co-divinylbenzene), poly((methoxybenzyl)-oxymethylstyrene-co-styrene), poly((methoxybenzyl)-oxymethylstyrene-co-ethyl methacrylate), poly((methoxybenzyl)-oxymethylstyrene)-co-methyl methacrylate), poly(styrene-co-(chloroethylsulfonylmethyl)-styrene), poly(styrene-co-acrylonitrile), poly(caprolactone), a polycarbonate, a polyurethane, a polyester, a poly(vinylchloride), or mixtures thereof. The dye image-receiving layer may be present in any amount which is effective for the intended purpose. In general, good results have been obtained at a concentration of from about 1 to about 5 g/m$^2$.

In a preferred embodiment of the invention, the dye image-receiving layer is a polycarbonate. The term "polycarbonate" as used herein means a polyester of carbonic acid and glycol or a divalent phenol. Examples of such glycols or divalent phenols are p-xylylene glycol, 2,2-bis(4-oxy-phenyl)propane, bis(4-oxyphenyl)methane, 1,1-bis(4-oxyphenyl)ethane, 1,1-bis(oxyphenyl)-butane, 1,1-bis(oxyphenyl)cyclohexane, 2,2-bis(oxyphenyl)butane, etc.

In another preferred embodiment of the invention, the polycarbonate dye image-receiving layer is a bisphenol-A polycarbonate having a number average molecular weight of at least about 25,000. In still another preferred embodiment of the invention, the bisphenol-A polycarbonate comprises recurring units having the formula:

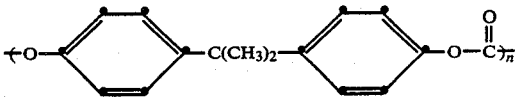

wherein n is from about 100 to about 500.

Examples of such polycarbonates include General Electric Lexan® Polycarbonate Resin #ML-4735 (Number average molecular weight app. 36,000), and Bayer AG Makrolon #5705® (Number average molecular weight app. 58,000). The later material has a $T_g$ of 150° C.

Specific polymers which can be used in this invention include the following:

Polyesters

Polycaprolactone

Tone PCL-700 ® Union Carbide

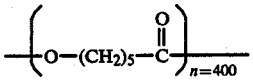

$T_g = -71°$ C.

Tone PCL-300 ® Union Carbide
n = 100

$T_g = -71°$ C.

Poly(butylene adipate)

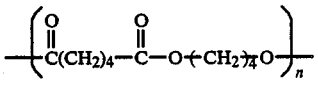

n = 25–500

$T_g = -68°$ C.

Polyester 1: A polyester derived from bisphenol-A and azelaic acid:

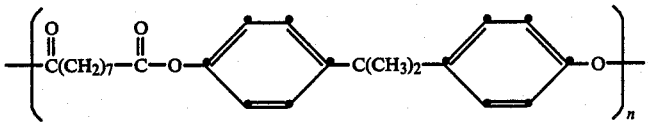

n = 15–300

$T_g = 39°$ C.

Polyester 2: A copolyester derived from bisphenol-A, 1,5-pentanediol, and azelaic acid:

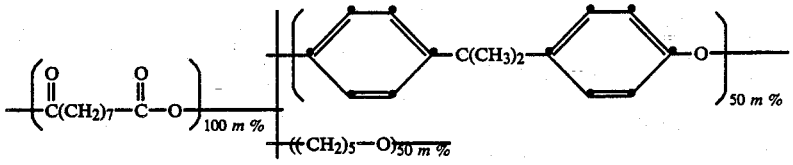

m.w. ≃ 20,000–100,000

$T_g = 20°$ C.

Polyester 3: A copolyester derived from bisphenol-A, 1,6-hexanediol, and azelaic acid:

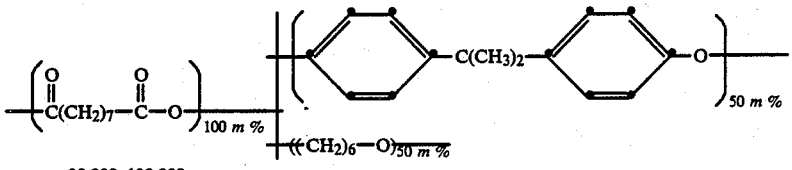

m.w. ≃ 20,000–120,000

$T_g = 15°$ C.

Polyester 4: Poly(pentamethylene-(5-carboxy-1,3,3-trimethylindane-1-(phenyl-4-carboxylate)))

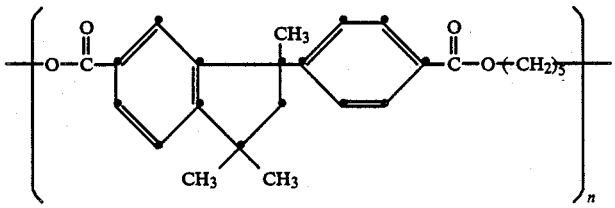

n = 15–300

$T_g = 103°$ C.

-continued

Polyester 5: Poly(hexamethylene-(5-carboxy-1,3,3-trimethylindane-1-(phenyl-4-carboxylate)))

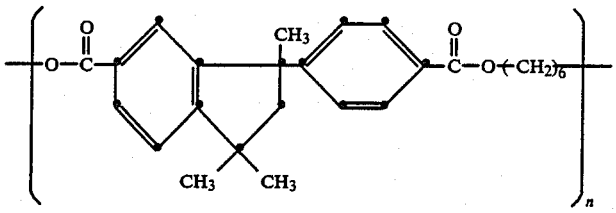

$T_g = 89°$ C.

n = 15–300

Polyester 6: Poly(octamethylene-(5-carboxy-1,3,3-trimethylindane-1-(phenyl-4-carboxylate)))

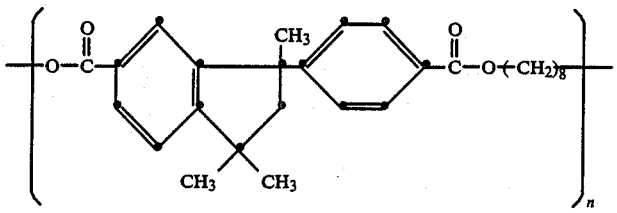

$T_g = 78°$ C.

n = 15–300

Polycarbonates

Polycarbonate 1: A copolycarbonate derived from bisphenol-A, 1,5-pentanediol, and carbonic acid:

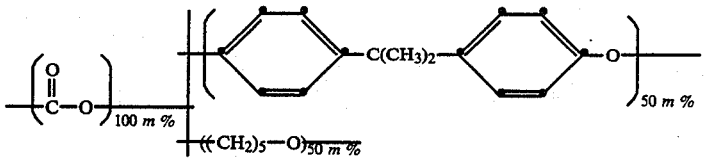

$T_g = 65°$ C.

m.w. ≃ 20,000–100,000

Polycarbonate 2: A copolycarbonate derived from bisphenol-A, 1,9-nonanediol, and carbonic acid:

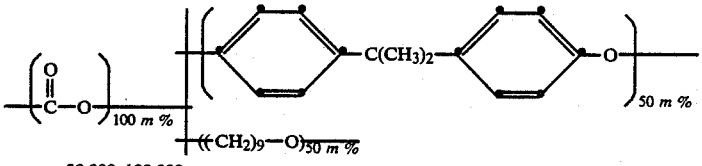

$T_g = 24°$ C.

m.w. ≃ 20,000–100,000

Polyurethanes:

Polyurethane 1: poly(iminocarbonyloxy-1,4-phenyleneisopropylidene-1,4-phenylene-oxycarbonyliminopentamethylene)

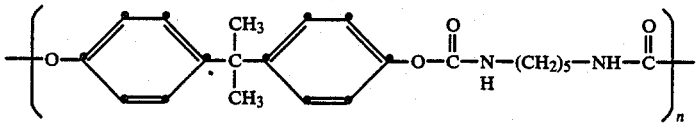

n = 15–300

Polyurethane 2: a polyurethane derived from bisphenol-A and hexamethylene diisocyanate

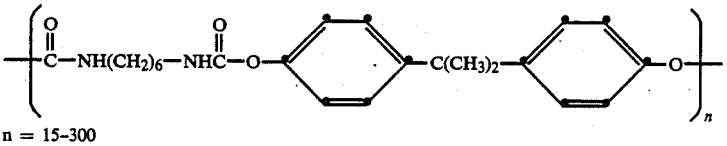

$T_g = 33°$ C.

n = 15–300

Polyurethane 3: a polyurethane derived from 1,6-hexanediol and 4,4'-methylenebis(cyclohexylisocyanate)

-continued

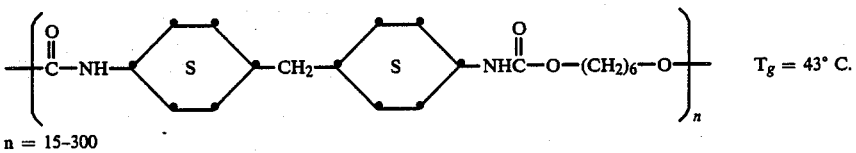

$T_g = 43°$ C.

n = 15–300

Polyurethane 4: a polyether urethane derived from 1,4-butanediol and 4,4'-methylenebis(cyclohexylisocyanate)

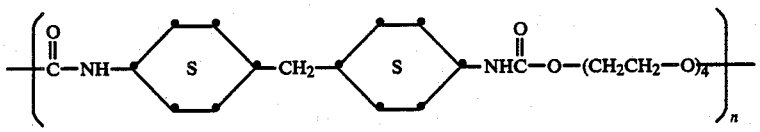

$T_g = 21°$ C.

n = 15–300

The support for the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyethylene-coated paper is employed. It may be employed at any thickness desired, usually from about 50 μm to about 1000 μm.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (product of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

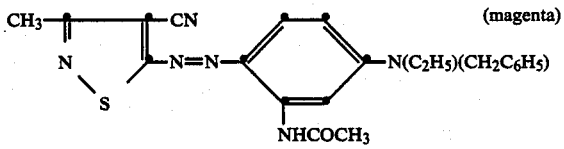

(magenta)

-continued

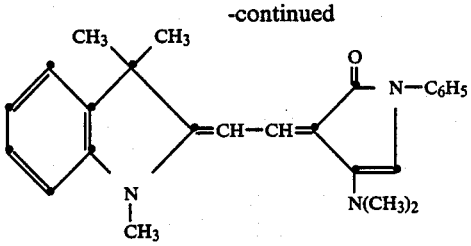

(yellow)

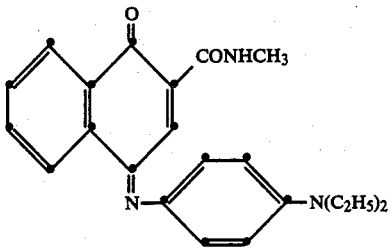

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed on the dye-donor element between its support and the dye layer which provides improved dye transfer densities. Such dye-barrier layer materials include those described and claimed in Application Ser. No. 934,968 entitled "Dye-Barrier/Subbing Layer for Dye-Donor Element Used in Thermal Dye Transfer" by Vanier et al, filed Nov. 25, 1986, now U.S. Pat. No. 4,700,208.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer layer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

The condensation polymers employed in the invention are prepared by established chemical techniques similar to the following:

PREPARATIVE EXAMPLES

Preparation of Polyester 1

To a stirred mixture of 4,4'-isopropylidene diphenol (22.8 g, 0.1 mole) and trimethylamine (22.3 g, 0.22 mole) in methylene chloride (200 ml) at 10° C. was added a solution of azelaoyl chloride (22.5 g, 0.1 mole) in methylene chloride (100 ml). The solution was stirred under nitrogen for 4 hours, during which triethylamine hydrochloride precipitated in a gelatinous form and the solution became viscous. The solution was then filtered and washed with dilute hydrochloric acid, 2% (100 ml) followed by water (3×200 ml). The solution was then poured into methanol with vigorous stirring, and a white fibrous polymer precipitated. The washed and dried polymer weighed 35.6 g (94%), polystyrene equivalent mw ≃74,000.

Preparation of Polyurethane 3

4,4'-methylene bis(cyclohexylisocyanate)-1,6-hexanediol

To a one-liter three-necked round bottom flask equipped with stirrer, condenser and nitrogen inlet were added 1,6-hexanediol (11.8 g, 0.1 mole), tetrahydrofuran (105. ml), and dibutyltin dilaurate (3 drops). The mixture was heated to 40° C. and a solution of 4,4'-methylene bis(cyclohexylisocyanate) (26.2 g, 0.1 mole) in tetrahydrofuran (50 ml) was added dropwise with stirring. The temperature was increased to 70° C. and stirring was continued for 24 hours until less than 0.3% of the isocyanate remained. The reaction mixture was cooled, and the resulting polymer was isolated in distilled water, collected, and dried. The polymer consisted of 18 percent solids in tetrahydrofuran with a weight-average molecular weight of 57,000 and a $T_g$ of 43° C.

EXAMPLE 1

Polyester and Polycarbonate Overcoat

Dye-receivers were prepared by coating the following layers on a 175 μm (7 mil) thick commercial paper stock consisting of 180 g/m$^2$ mixture of hard wood-craft and soft wood-sulfite bleach pulp:

(a) Pigmented polyethylene layer of total laydown 30 g/m² with approximately 12% by weight anatase titanium dioxide and 3% zinc oxide;

(b) Subbing layer of poly(acrylonitrile-co-vinylidene chloride-co-acrylic acid (14:79:7 wt ratio) (0.05 g/m²) coated from 2-butanone;

(c) Dye-receiving layer of Makrolon 5705 ® polycarbonate (Bayer AG) (2.9 g/m²), and 1,4-didecoxy-2,5-dimethoxybenzene (0.38 g/m²) coated from a dichloromethane and trichloroethylene solvent mixture; and (d) Overcoat layer of the polymer identified in Table 1 at the indicated coverage and 3M Corp. FC-431 ® surfactant (0.016 g/m²) coated from either dichloromethane or a toluene-methanol solvent mixture.

An antistatic layer and anticurl layer of polyethylene were coated on the reverse side of the paper support.

A cyan, magenta and yellow dye-donor element was prepared as follows. On one side of a 6 μm poly(ethylene terephthalate) support, a subbing layer of a titanium alkoxide (duPont Tyzor TBT ®) (81. mg/m²) was Gravure-printed from a n-propyl acetate and 1-butanol solvent mixture. On top of this layer were Gravure-printed repeating color patches of cyan, magenta and yellow dyes. The cyan coating contained the cyan dye illustrated above (0.28 g/m²) and cellulose acetate propionate (2.5% acetyl, 45% propionyl) binder (0.44 g/m²) from a toluene, methanol and cyclopentanone solvent mixture. The magenta coating contained the magenta dye illustrated above (0.15 g/m²) in the same binder as the cyan dye (0.32 g/m²). The yellow coating contained the yellow dye illustrated above (0.14 g/m²) in the same binder as the cyan dye (0.25 g/m²).

On the reverse side of the dye-donor was coated a subbing layer of Bostik 7650 ® polyester (Emhart Corp.) (43. mg/m²) coated from a toluene and 3-pentanone solvent mixture and a slipping layer of duPont Zonyl UR ® phosphate ester (66. mg/m²) and BYK-320 ® silicone polymer (BYK Chemie USA) (41 mg/m²) in a poly(styrene-co-acrylonitrile) (70:30 wt ratio) binder (0.22 g/m²) from a methanol and 3-pentanone solvent mixture.

The dye-side of the dye-donor element strip 4 inches (10. cm) wide was placed in contact with the dye image-receiving layer of a dye-receiver element strip of the same width. The assemblage was fastened in a clamp on a rubber-roller of 2.22 in (56.4 mm) diameter driven by a stepper motor. A TDK L231R Thermal Head was pressed at a force of 8 pounds (3.6 kg) against the dye-donor element side of the assemblage pushing it against the rubber roller.

The imaging electronics were activated causing the device to draw the assemblage between the printing head and roller at 0.28 inches/sec (7. mm/sec). Coincidentally the resistive elements in the thermal print was heated. A "caucasian skin patch" image area having a Status A blue density of between 0.4 and 0.7 and a green density of between 0.4 and 0.7 was generated using sequential printing from an area of the cyan, magenta and yellow dye-donor. The voltage supplied to the print-head for this imaging was approximately 23.5 v, representing approximately 10 watts/dot (23. mjoules/-pixel group) for neutral D-max areas.

The $\Delta T_g$ was calculated using the $T_g$ figures given above for the materials listed in Table 1.

The Status A blue density of the "caucasian skin" patch was read and recorded. Each sample was then subjected to fading for 7 days, 50 kLux, 5400° C., 32° C., approximately 25% RH and the same area was re-read to calculate the percent density loss. The following results were obtained:

TABLE 1

| Polymer Overcoat (g/m²) | $\Delta T_g$ | Blue Density Initial | Blue Density % Density Loss |
|---|---|---|---|
| None (Control) | * | 0.39 | 62 |
| Polyester 1 (0.43 g/m²) | 111° C. | 0.35 | 29 |
| Polycarbonate 1 (0.32 g/m²) | 85° C. | 0.51 | 43 |
| Polycarbonate 2 (0.32 g/m²) | 126° C. | 0.55 | 42 |

*The $T_g$ of the polycarbonate dye image receiving layer is 150° C.

The above data show the effectiveness of overcoats of polymers of the invention to minimize yellow dye-density loss of a composite cyan, magenta, and yellow "caucasian-skin" image area.

EXAMPLE 2

Polycaprolactone Overcoat

Dye-receivers were prepared as described in Example 1 except overcoat layer (d) consisted of Tone PCL-700 ® polycaprolactone (Union Carbide) and Tone PCL-300 ® polycaprolactone (Union Carbide) (at the indicated level in Table 2) and 3M Corp. FC-431 ® surfactant (0.16 g/m²) coated from a dichloromethane and trichloroethylene solvent mixture.

A dye-donor element was prepared as in Example 1 and was processed as in Example 1 with the following results:

TABLE 2

| Polycaprolactone Overcoat (g/m²) | $\Delta T_g$ | Blue Density Initial | Blue Density % Density Loss |
|---|---|---|---|
| None (control) | * | 0.60 | 60 |
| Tone PCL-700 (0.43 g/m²) | 221° C. | 0.66 | 38 |
| Tone PCL-300 (0.21 g/m²) | 221° C. | 0.64 | 46 |
| Tone PCL-300 (0.42 g/m²) | 221° C. | 0.63 | 41 |

*The $T_g$ of the polycarbonate dye image receiving-layer is 150° C.

The data show the effectiveness of a polycaprolactone receiver layer overcoat for minimizing yellow dye density loss.

EXAMPLE 3

Polyester Overcoat

This Example is similar to Example 1 but used a variety of other polyesters of varying aliphatic carbon chain-length to show the specificity of overcoat polymer structure and $T_g$.

Dye-receivers were prepared as described in Example 1 except that the overcoat layer (d) consisted of polyesters listed in Table 3 and 3M Corp. FC-431 surfactant (5.4 g/m²) coated from a methylene chloride solvent mixture.

The following control polymers were also evaluated:

Control Polyester 1: poly(dimethylene-(5-carboxy-1,3,3-trimethylindane-1-(phenyl-4-carboxylate)))

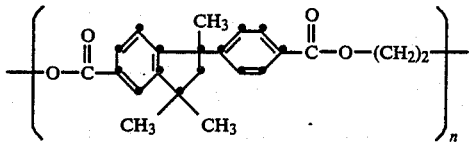

$T_g$ = 138° C.

This polymer contains only a two carbon aliphatic segment.

Control Polyester 2: Poly(bisphenol A-(5-carboxy-1,3,3-trimethylindane-1-(phenyl-4-carboxylate)))

The structure is the same as control polyester 1, but with bisphenol-A replacing the ethylene glycol group. This polymer contains no aliphatic carbon segment.

$T_g$=241° C.

A dye-donor element was prepared as in Example 1 and was processed as in Example 1 with the following results:

TABLE 3

| Polymer Overcoat (g/m²) | $\Delta T_g$ °C. | Blue Density Initial | Blue Density % Density Loss |
|---|---|---|---|
| None (control) | * | 0.60 | 60 |
| Control Polyester 1 (0.21 g/m²) | 12 | 0.54 | 69 |
| Control Polyester 2 (0.21 g/m²) | −91 | 0.60 | 70 |
| Polyester 1 (0.21 g/m²) | 111 | 0.75 | 51 |
| Polyester 2 (0.21 g/m²) | 130 | 0.57 | 51 |
| Polyester 3 (0.21 g/m²) | 135 | 0.49 | 53 |
| Polyester 4 (0.21 g/m²) | 47 | 0.64 | 50 |
| Polyester 5 (0.21 g/m²) | 61 | 0.70 | 44 |
| Polyester 6 (0.21 g/m²) | 72 | 0.69 | 46 |
| Poly(butylene adipate) (0.21 g/m²) | 218 | 0.59 | 53 |

*The $T_g$ of the polycarbonate dye image-receiving layer is 150° C.

The above data show the necessity of having an aliphatic chain of at least four carbon atoms and a $T_g$ of the overcoat polymer at least 40° C. less than the $T_g$ of the dye image-receiving layer polymer to show beneficial dye stability improvements.

EXAMPLE 4

This example shows that the overcoat polymers of the invention should not be mixed with the receiver polymers and that a separate discrete overcoat layer is required above the receiver layer to obtain optimum dye stability.

(A) A dye-receiving element was prepared as in Example 1 except that the subbing layer (b) was coated at 0.08 g/m². On top of that layer was coated the following dye image-receiving layer: Makrolon 5705® polycarbonate (Bayer AG) (2.9 g/m²), 1,4-didecoxy-2,5-dimethoxybenzene (0.38 g/m²) and 3M Corp. FC-431® surfactant (0.016 g/m²) coated from dichloromethane solvent.

(B) Another dye-receiving element was prepared similar to (A) except that it also contained Union Carbide Tone PCL-300® polycaprolactone (0.87 g/m²) and Makrolon 5705® polycarbonate at 2.03 g/m².

(C) Dye-receiving elements according to the invention were prepared by overcoating (A) with the following layer: Union Carbide Tone PCL-300® polycaprolactone in the concentration listed in Table 4 below and 3M Corp. FC-431® surfactant (0.05 g/m²) coated from dichloromethane solvent.

A dye-donor was prepared as in Example 1 and processing was performed as in Example 1 except that the transferred images were fused by passage of the receiver through a set of rollers heated to 100° C. (this will change the absolute but not the relative values for dye light stability). The following results were obtained:

TABLE 4

| Receiver Element | Polymer Overcoat (g/m²) | Blue Density Initial | Blue Density % Density Loss |
|---|---|---|---|
| A | None (control) | 0.62 | 53 |
| B | None (control) | 0.61 | 51 |
| C | Polycaprolactone (0.01) | 0.42 | 45 |
| C | Polycaprolactone (0.05) | 0.60 | 28 |
| C | Polycaprolactone (0.11) | 0.41 | 24 |
| C | Polycaprolactone (0.22) | 0.51 | 12 |
| C | Polycaprolactone (0.32) | 0.67 | 13 |

The above results indicate that a discrete overcoat layer is required and that as little as 0.01 g/m² overcoat polymer is effective in improving dye light stability with greater improvements occurring as the amount of the polymer layer is increased.

EXAMPLE 5

Polyurethane Overcoat

This Example is similar to Example 1 but used a variety of polyurethanes.

Dye-receivers were prepared as described in Example 1 except that the overcoat layer (d) consisted of polyurethanes listed in Table 5 coated from a dichloromethane and trichloroethylene solvent mixture.

A dye-donor element was prepared as in Example 1 and was processed as in Example 1 with the following results:

TABLE 5

| Polymer Overcoat (g/m²) | $\Delta T_g$ °C. | Blue Density Initial | Blue Density % Density Loss |
|---|---|---|---|
| None (control)* | ** | 0.58 | 53 |
| Control Polyester 1 (0.22 g/m²) | 12 | 0.56 | 59 |
| Control Polyester 1 (0.43 g/m²) | 12 | 0.61 | 61 |
| Polyurethane 2 (0.22 g/m²) | 117 | 0.51 | 37 |
| Polyurethane 2 (0.22 g/m²) | 117 | 0.58 | 38 |
| Polyurethane 2 (0.43 g/m²) | 117 | 0.54 | 26 |
| Polyurethane 2 (0.43 g/m²) | 117 | 0.67 | 22 |
| None (control) | ** | 0.55 | 62 |
| Polyurethane 3 (0.22 g/m²) | 107 | 0.64 | 51 |
| Polyurethane 4 (0.22 g/m²) | 129 | 0.62 | 53 |

*Contained a thin overcoat of Dow-Corning DC-510® Silicone Fluid (0.016 g/m²) coated from methylene chloride.

**The $T_g$ of the polycarbonate dye image-receiving layer is 150° C.

The above data show the effectiveness of the polyurethane overcoats to minimize yellow dye-density loss of a composite cyan, magenta, and yellow "caucasian skin" image area.

The invention has been described in detail with particular reference to preferred embodiments thereof, but it will be understood that variations and modifications can be effected within the spirit and scope of the invention.

What is claimed is:

1. In a dye-receiving element comprising a support having thereon a thermally-transferred dye image in a dye image-receiving layer, the improvement wherein said dye image-receiving layer is coated with an overcoat layer comprising a condensation polymer comprising recurring units of a linear chain having at least four carbon atoms, said overcoat layer having a $T_g$ of at least 40° C. less than the $T_g$ of said dye image-receiving layer.

2. The element of claim 1 wherein said condensation polymer is a polyester.

3. The element of claim 2 wherein said polyester is polycaprolactone.

4. The element of claim 2 wherein said polyester is poly(butylene adipate).

5. The element of claim 2 wherein said polyester is a polycarbonate.

6. The element of claim 1 wherein said condensation polymer is a polyurethane.

7. The element of claim 1 wherein said dye image-receiving layer is a bisphenol-A polycarbonate having a number average molecular weight of at least about 25,000.

8. The element of claim 7 wherein said bisphenol-A polycarbonate comprises recurring units having the formula:

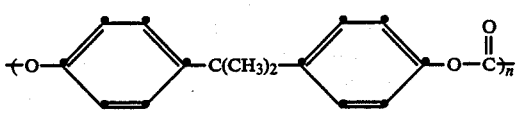

wherein n is from about 100 to about 500.

9. The element of claim 1 wherein said support is paper.

10. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, the improvement wherein said dye image-receiving layer is coated with an overcoat layer comprising a condensation polymer comprising recurring units of a linear chain having at least four carbon atoms, said overcoat layer having a $T_g$ of at least 40° C. less than the $T_g$ of said dye image-receiving layer.

11. The process of claim 10 wherein said condensation polymer is a polyester.

12. The process of claim 11 wherein said polyester is a polycarbonate.

13. The process of claim 10 wherein said condensation polymer is a polyurethane.

14. The process of claim 10 wherein said support for the dye-donor element comprises poly(ethylene terephthalate) which is coated with sequential repeating areas of cyan, magenta and yellow dye, and said process steps are sequentially performed for each color to obtain a three-color dye transfer image.

15. In a thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye image-receiving layer is coated with an overcoat layer comprising a condensation polymer comprising recurring units of a linear chain having at least four carbon atoms, said overcoat layer having a $T_g$ of at least 40° C. less than the $T_g$ of said dye image-receiving layer.

16. The assemblage of claim 15 wherein the support of said dye image-receiving element is paper and said dye image-receiving layer is a bisphenol-A polycarbonate having a number average molecular weight of at least about 25,000.

17. The assemblage of claim 15 wherein said condensation polymer is a polyester.

18. The assemblage of claim 17 wherein said polyester is a polycarbonate.

19. The assemblage of claim 15 wherein said condensation polymer is a polyurethane.

* * * * *